US010240557B2

(12) United States Patent
Boczek et al.

(10) Patent No.: US 10,240,557 B2
(45) Date of Patent: Mar. 26, 2019

(54) COOLING CHANNEL COVER AND PISTON PROVIDED WITH A COOLING CHANNEL COVER

(71) Applicant: Mahle International GmbH, Stuttgart (DE)

(72) Inventors: Sascha-Oliver Boczek, Dielheim (DE); Timo Linke, Stuttgart (DE); Rainer Scharp, Vaihingen (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 15/523,210

(22) PCT Filed: Oct. 27, 2015

(86) PCT No.: PCT/EP2015/074782
§ 371 (c)(1),
(2) Date: Apr. 28, 2017

(87) PCT Pub. No.: WO2016/066599
PCT Pub. Date: May 6, 2016

(65) Prior Publication Data

US 2017/0321629 A1 Nov. 9, 2017

(30) Foreign Application Priority Data

Oct. 30, 2014 (DE) ..... 10 2014 015 946

(51) Int. Cl.
*F02F 3/10* (2006.01)
*F02F 3/22* (2006.01)
*F02F 3/24* (2006.01)

(52) U.S. Cl.
CPC ..... *F02F 3/22* (2013.01); *F02F 3/10* (2013.01); *F02F 3/24* (2013.01)

(58) Field of Classification Search
CPC ..... F02F 3/22; F02F 3/10; F02F 3/24
(Continued)

(56) References Cited

U.S. PATENT DOCUMENTS 4,986,167 A 1/1991 Stratton et al.
5,261,363 A 11/1993 Kemnitz
(Continued)

FOREIGN PATENT DOCUMENTS

DE 4208037 A1 9/1993
DE 19960913 A1 6/2001
(Continued)

OTHER PUBLICATIONS

Japanese Office Action dated Oct. 3, 2017 related to corresponding Japanese Patent Application No. 2017-523491.
(Continued)

*Primary Examiner* — Joseph J Dallo
*Assistant Examiner* — Yi-Kai Wang
(74) *Attorney, Agent, or Firm* — Fishman Stewart PLLC

(57) ABSTRACT

A cooling channel cover for a piston of an internal combustion engine may include a body having mutually opposite end faces. At least one supply element for a coolant may be received in an opening disposed in the cooling channel cover. The supply element may include an inlet region and an outlet region, and may be held on the cooling channel cover via a clipped-in latching connection. A spring tab may be disposed on the inlet region of the supply element, and/or a latching element may be disposed on the outlet region of the supply element. The spring clip may engage one of the end faces and the latching element may engage the opposite end face.

19 Claims, 3 Drawing Sheets

(58) Field of Classification Search
USPC ..... 123/193.6
See application file for complete search history.

(56) References Cited

U.S. PATENT DOCUMENTS

| | | | | |
|---|---|---|---|---|
| 5,401,595 | A * | 3/1995 | Kagawa | H01M 2/0212 429/152 |
| 5,546,896 | A | 8/1996 | Zaiser | |
| 6,401,595 | B1 * | 6/2002 | Bochart | F02F 3/00 92/186 |
| 6,634,278 | B2 * | 10/2003 | Bochart | B23P 15/10 92/186 |
| 6,722,263 | B2 | 4/2004 | Keller et al. | |
| 8,661,965 | B2 | 3/2014 | Scharp et al. | |
| 9,341,137 | B2 | 5/2016 | Leitl | |
| 2002/0056367 | A1 | 5/2002 | Bochart | |
| 2002/0178910 | A1 * | 12/2002 | Keller | F02F 3/22 92/208 |
| 2005/0115523 | A1 * | 6/2005 | Bauer | F02F 3/22 123/41.35 |
| 2012/0222632 | A1 * | 9/2012 | Scharp | F02F 3/003 123/41.37 |

FOREIGN PATENT DOCUMENTS

| | | | |
|---|---|---|---|
| DE | 102009056922 | A1 | 6/2011 |
| DE | 102010056220 | A1 | 6/2012 |
| DE | 102011106379 | A1 | 1/2013 |
| EP | 1199461 | A1 | 4/2002 |
| EP | 1238191 | A1 | 9/2002 |
| EP | 1238191 | B1 | 7/2005 |
| JP | 56-090111 | A | 7/1981 |
| JP | 04-500550 | B2 | 1/1992 |
| JP | 2003-517139 | A | 5/2003 |
| JP | 2009-270615 | A | 11/2009 |
| JP | 2011-094645 | A | 5/2011 |
| JP | 2015161330 | A | 9/2015 |
| WO | WO-01/44645 | A1 | 6/2001 |

OTHER PUBLICATIONS

English abstract for DE-102009056922.
Final Decision for Patent dated Aug. 21, 2018, related to corresponding Japanese Patent Application No. 2017-523491.

* cited by examiner

COOLING CHANNEL COVER AND PISTON PROVIDED WITH A COOLING CHANNEL COVER

CROSS-REFERENCE TO RELATED APPLICATIONS

This application claims priority to German Application No. 10 2014 015 946.9, filed on Oct. 30, 2014, and International Patent Application No. PCT/EP2015/074782, filed on Oct. 27, 2015, the contents of which are hereby incorporated by reference in their entirety.

TECHNICAL FIELD

The present invention relates to a cooling channel cover for a piston of an internal combustion engine, said cover having mutually opposite end faces, with a supply element for cooling oil having an inlet region and an outlet region, wherein the supply element is received in an opening provided in the cooling channel cover and held on the cooling channel cover by a clipped-in latching connection. The present invention further relates to a piston provided with such a cooling channel cover.

BACKGROUND

A cooling channel cover of the generic type is known from EP 1 238 191 B1. This known cooling channel cover has an intrinsically elastic supply element which is received in an opening provided in the cooling channel cover and fastened thereto by means of a latching connection or by clipping in. For mounting purposes, the known supply element is deformed elastically inward in order to be able to guide it through the opening in the cooling channel cover. This requires that the known supply element is provided only with very small solid latching noses and bearing surfaces which have only very little contact with the cooling channel cover. Reliable operation of a piston provided with such a cooling channel cover is not reliably ensured on account of the forces occurring on the latching noses and bearing surfaces during engine operation and on account of the thus occurring wear in the region of the latching noses and bearing surfaces.

SUMMARY

The object of the present invention therefore consists in developing a cooling channel cover of the generic type in such a way that reliable operation of a piston provided therewith is ensured without excessively increasing the mass of the supply element and thus the inertia forces acting during engine operation.

The solution consists in the fact that the supply element has, at the inlet region, at least one spring tab which extends radially outward in the circumferential direction of the cooling channel cover and, at the outlet region, at least one latching element which is radially elastic in the circumferential direction of the cooling channel cover, wherein the at least one spring tab bears against one end face and the at least one latching element bears against the opposite end face of the cooling channel cover.

The present invention further relates to a piston for an internal combustion engine having such a cooling channel cover.

The spring tongues and latching elements provided according to the invention have the advantage that, combined with a low mass, they allow a larger surface contact between the supply element and the cooling channel cover than is the case in the prior art. The wear during engine operation is thus considerably reduced in this region by comparison with the prior art. Furthermore, it is no longer necessary to design the entire supply element to be intrinsically elastic, which substantially increases the strength of the latching connection according to the invention.

Advantageous developments can be found in the subclaims.

In each case two spring tabs and latching elements which are radially opposite one another in the circumferential direction of the cooling channel cover are preferably provided. The strength of the latching connection according to the invention is thus further increased.

Furthermore, the forces which act during engine operation act symmetrically on the supply element, with the result that wear is further reduced.

A preferred development consists in the fact that the at least one latching element bears by way of a bearing surface and the at least one spring tab bears by way of a bearing surface against the end faces of the cooling channel cover, and that the size of the bearing surface of the at least one latching element is from 30% to 60% of the size of the bearing surface of the at least one spring tab. This preferred development takes account of the circumstance that the acceleration of the piston according to the invention is different at the top and bottom dead center during engine operation, since the maximum acceleration at the top dead center is approximately twice as high as the maximum acceleration at the bottom dead center. The different size of the bearing surfaces of latching element and spring tab thus means that the wear behavior is optimized in this region.

The inlet region of the supply element is expediently designed to be widened in a funnel shape in order to optimize the entry of cooling oil injected by means of a cooling oil nozzle. The outlet region is preferably designed as a standpipe, with the result that the cooling oil issuing into the cooling channel is optimally distributed.

The supply element can have a passage opening with a round cross section. However, the cross section of the passage opening can also be designed to be larger in the circumferential direction of the cooling channel cover than in the radial direction of the cooling channel cover in order to increase the receiving capacity of the supply element for cooling oil.

The supply element can consist of a plastic and/or a metallic material, with only the at least one spring tab or the at least one latching element having to be designed to be elastic.

The cooling channel cover can be designed as a component which is separate from the piston, for example as a two-part elastic component, which can be produced in particular from a spring sheet. However, the cooling channel cover can also be formed integrally on the piston.

BRIEF DESCRIPTION OF THE DRAWINGS

Exemplary embodiments of the present invention are described in more detail hereinbelow with reference to the appended drawings, in which, in a schematic illustration which is not true to scale.

DETAILED DESCRIPTION

Figure 1:
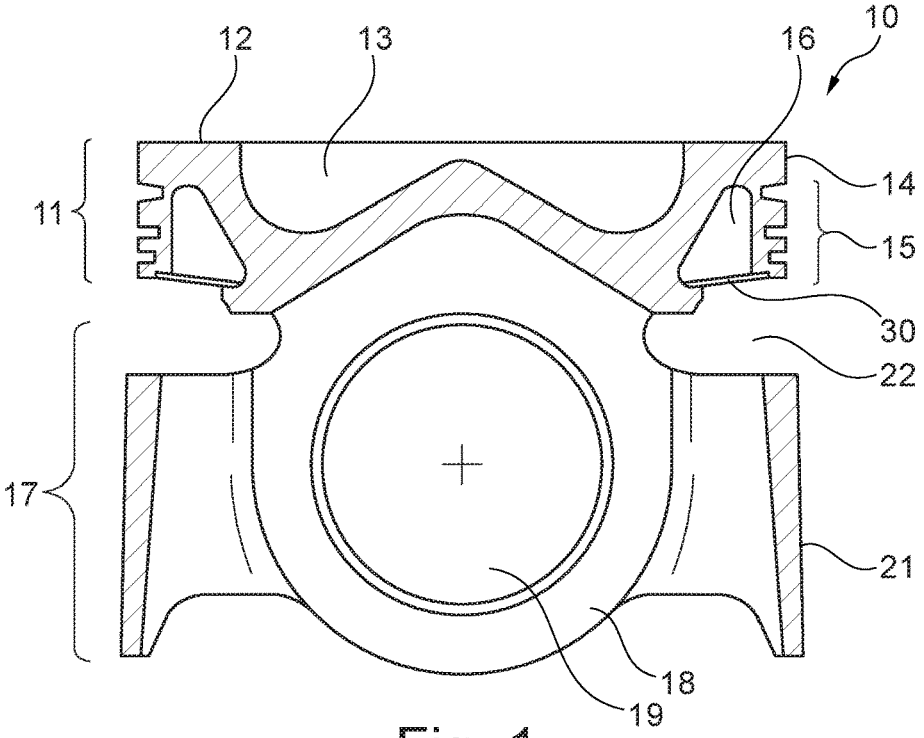
FIG. 1 shows an exemplary embodiment of a piston according to the invention in section, with the supply element not being illustrated for reasons of clarity.

A piston 10 is illustrated by way of example in FIG. 1. The piston 10 is designed as a slipper piston and has a piston head 11 with a piston crown 12 in which a combustion recess 13 is made. The piston head 11 further has a fire land 14 and a ring zone 15 with ring grooves for receiving piston rings (not shown). The piston is provided, level with the ring zone 15, with a peripheral, downwardly open cooling channel 16 which is closed by a cooling channel cover 30. The piston further has, in a manner known per se, a piston skirt 17 with piston bosses 18 which are provided with boss bores 19 for receiving a piston pin (not shown). The piston bosses 18 are connected to one another via running surfaces 21 in a manner known per se, the running surfaces 21 being thermally decoupled from the piston head 11 by means of cutouts 22.

Figure 2:
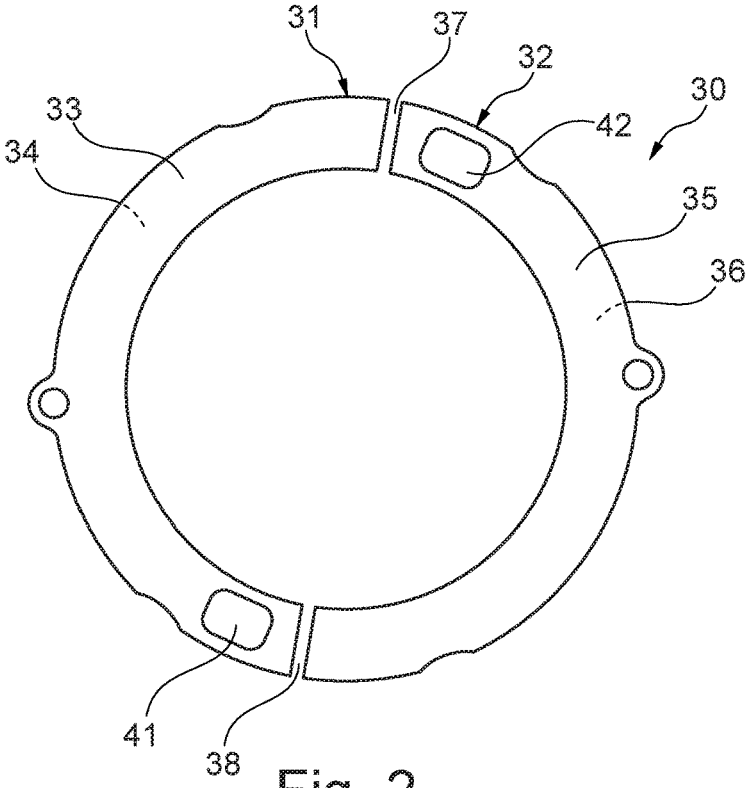
FIG. 2 shows an exemplary embodiment of a cooling channel cover for a piston as per FIG. 1 in a plan view, with the supply element not being illustrated for reasons of clarity.

FIG. 2 shows an exemplary embodiment of a cooling channel cover 30 according to the invention. The cooling channel cover 30 consists of two semicircular part-covers 31, 32 which, in the exemplary embodiment, are produced from an elastic spring sheet and each have two end faces 33, 34; 35, 36. In each case two mutually opposite end regions of the part-covers 31, 32 form a joint opening 37, 38. In the exemplary embodiment, each part-cover 31, 32 has an opening 41, 42 made therein for receiving a supply element 50 according to the invention.

In a further embodiment, it is also conceivable that the opening receiving the supply element 50 can also be formed by at least one joint opening 37, 38.

Figure 3:
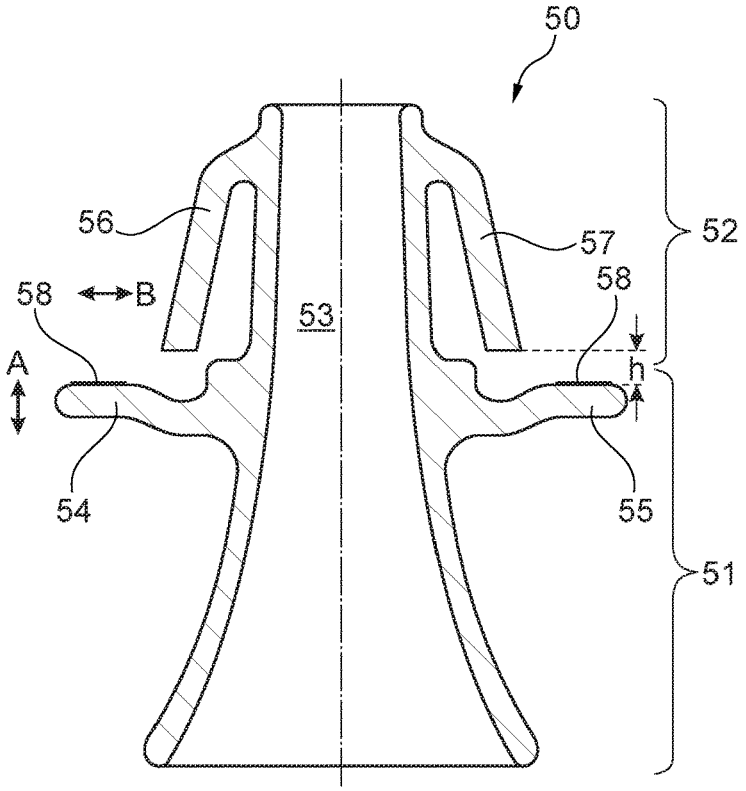
FIG. 3 shows an exemplary embodiment of a supply element according to the invention for a cooling channel cover as per FIG. 2, in section.
Figure 4:
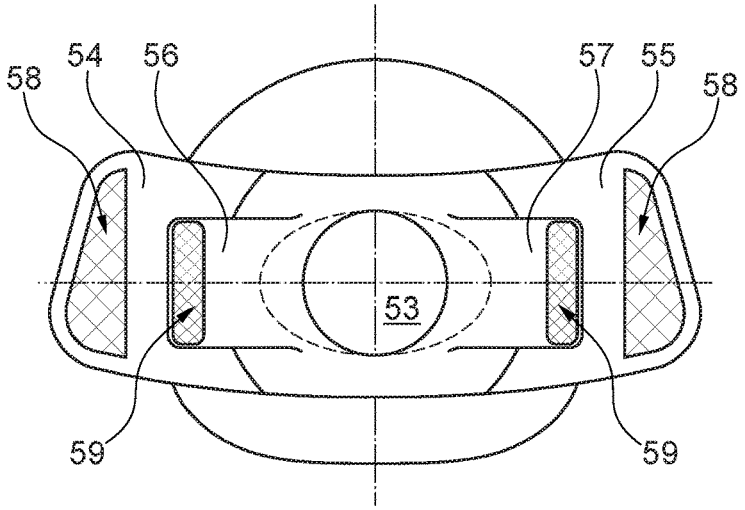
FIG. 4 shows an illustration of the bearing surfaces on the supply element as per FIG. 3.
Figure 5:
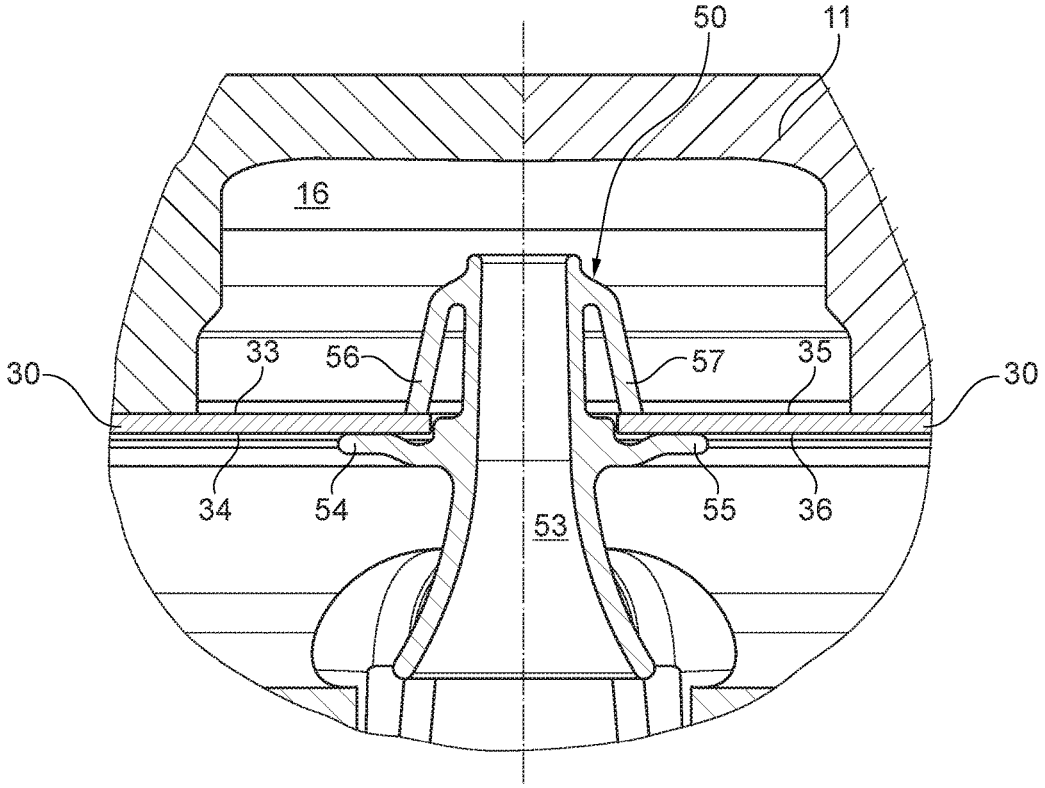
FIG. 5 shows the supply element as per FIG. 3 fastened to the cooling channel cover as per FIG. 2 in a piston as per FIG. 1, in the mounted state.

FIGS. 3 to 5 show an exemplary embodiment of a supply element 50 according to the invention as an individual part (FIGS. 3 and 4) and in the mounted state (FIG. 5). The supply element 50 has an inlet region 51 which projects from the cooling channel 16 in the piston 10 in the mounted state (see FIG. 5). The supply element 50 further has an outlet region 52 which opens into the cooling channel 16 in the piston 10 in the mounted state (see FIG. 5). A continuous passage opening 53 is provided in the supply element 50. The cross section of the passage opening 53 is circular as a rule. However, as indicated by a dashed line in FIG. 4, the cross section of the passage opening 53 can also be longer in the direction of the longitudinal axis of the spring tabs 54, 55 than perpendicular to the longitudinal axis of the spring tabs 54, 55. In the exemplary embodiment, the inlet region 51 of the supply element 50 is widened in a funnel shape toward its free end, whereas the outlet region 52 is designed as a standpipe.

Two mutually opposite spring tabs 54, 55 are arranged at the inlet region 51 in the vicinity of the outlet region 52, said spring tabs being designed to be elastic in the direction of the arrows A and extending radially outward and, in the mounted state, in the circumferential direction of the cooling channel cover 30 (see FIGS. 4 and 5). Two mutually opposite latching elements 56, 57 which are radially elastic in the direction of the arrows B are provided at the upper end of the outlet region 52, said latching elements extending in the direction of the inlet region 51 and the free ends thereof assuming a defined spacing h from the spring tabs 54, 55 that is dependent on the thickness of the cooling channel cover 30. It can be seen in particular from FIG. 4 that the spring tabs 54, 55 have one bearing surface 58 each and the latching elements 56, 57 have one bearing surface 59 each, by means of which they bear, in the mounted state, against the end faces 33, 35 and 34, 36 of the part-covers 31, 32 of the cooling channel cover 30 (see FIG. 5). The size of each bearing surface 59 of the latching elements 56, 57 is approximately from 30% to 60% of the size of each bearing surface 58 of the spring tabs 54, 55.

In the exemplary embodiment described, for mounting purposes the cooling channel cover 30 is first connected to the piston 10 in a manner known per se in order to close the cooling channel 16. The openings 41 and 42 of the part-covers 31, 32 for receiving the supply elements 50 are generally arranged very close to the outer wall of the piston bosses 18. This means that, in a view from below, the spring tabs 54, 55 project beyond the outer wall of the piston bosses 18. For mounting purposes, the supply element 50 is first moved past the outer wall of the piston bosses 18 axially in the direction of the piston crown 12. As soon as the spring tabs 54, 55 come to lie on the side of and above the outer wall of the piston bosses 18, there occurs a relative movement in a plane parallel to the piston crown 12 until the supply element 50 is aligned with the opening 41 or 42 in the cooling channel cover 30 and the spring tabs 54, 55 are oriented in the circumferential direction of the cooling channel cover 30. In each case a spring tab 54 can optionally cover a joint opening 37 or 38. The outlet region 52 of the supply element 50 is then guided through the opening 41 or 42 while compressing the latching elements 56, 57 in the piston axial direction until the spring tabs 54, 55 bear against the end faces 34, 36 of the part-covers 31, 32 of the cooling channel cover 30. As soon as the latching elements 56, 57 have passed completely through the opening 41, 42, they snap back into their original position. The cooling channel cover 30 is now arranged between the bearing surfaces 58 of the spring tabs 54, 55 and the bearing surfaces 59 of the latching elements 56, 57. The supply element 50 is held firmly on the cooling channel cover 30 and is supported by way of its bearing surfaces 58, 59 on the cooling channel cover 30 (see FIG. 5).

The invention claimed is:

1. A cooling channel cover for a piston of an internal combustion engine, comprising:

a body having mutually opposite end faces and an opening;

at least one supply element for cooling oil having an inlet region and an outlet region, the at least one supply element received in the opening and held on the body via a clipped-in latching connection;

the at least one supply element including at least one spring tab disposed at the inlet region extending radially outward in a circumferential direction of the body, and at least one latching element disposed at the outlet region that is radially elastic in the circumferential direction of the body;

wherein the at least one spring tab bears against one end face of the mutually opposite end faces and the at least one latching element bears against the other end face of the mutually opposite end faces; and wherein the at least one spring tab includes two spring tabs and the at least one latching element includes two latching elements, and wherein the two spring tabs and the two latching elements are disposed radially opposite one another in the circumferential direction of the body.

2. The cooling channel cover as claimed in claim 1, wherein the at least one spring tab of the two spring tabs bears against the one end face via a bearing surface and the at least one latching element of the two latching elements bears against the other end face via a bearing surface, and wherein the bearing surface of the at least one latching element has a size that is from 30% to 60% of a size of the bearing surface of the at least one spring tab.

3. The cooling channel cover as claimed in claim 1, wherein the inlet region of the at least one supply element is widened in a funnel shape.

4. The cooling channel cover as claimed in claim 1, wherein the outlet region of the at least one supply element is a standpipe.

5. The cooling channel cover as claimed in claim 1, wherein the at least one supply element has a passage opening with a round cross section.

6. The cooling channel cover as claimed in claim 1, wherein the at least one supply element has a passage opening defining a cross section having a radius that is larger in the circumferential direction of the body than in a radial direction of the body.

7. The cooling channel cover as claimed in claim 1, wherein the at least one supply element includes at least one of a plastic material and a metallic material.

8. The cooling channel cover as claimed in claim 1, wherein the body is structured as a two-part elastic component.

9. The cooling channel cover as claimed in claim 8, wherein the two-part elastic component is a spring sheet.

10. A piston for an internal combustion engine, comprising:

a cooling channel cover having a first end face and a second end face disposed mutually opposite one another, and an opening extending transversely therethrough;

at least one supply element for cooling oil having an inlet region and an outlet region, the at least one supply element received in the opening and held on the cooling channel cover via a clipped-in latching connection;

the at least one supply element including at least one spring tab disposed at the inlet region extending radially outward in a circumferential direction of the cooling channel cover, and at least one latching element disposed at the outlet region that is radially elastic in the circumferential direction of the cooling channel cover;

wherein the at least one spring tab bears against the first end face and the at least one latching element bears against the second end face; and wherein the at least one latching element protrudes radially outwardly from the outlet region of the at least one supply element and extends in a direction towards the inlet region to a free end, and wherein the at least one latching element extends in the direction towards the inlet region with a radial spacing from the at least one supply element.

11. The piston as claimed in claim 10, wherein the at least one latching element includes two latching elements arranged mutually opposite to one another at the outlet region of the at least one supply element.

12. The piston as claimed in claim 10, wherein the at least one spring tab includes two spring tabs arranged mutually opposite one another at the inlet region of the at least one supply element, and wherein the two spring tabs each define a longitudinal axis extending radially outwardly from the at least one supply element and oriented in the circumferential direction of the cooling channel cover.

13. The piston as claimed in claim 10, further comprising a piston head, wherein the cooling channel cover is structured as a separate component attached to the piston head.

14. The piston as claimed in claim 10, further comprising a piston head, wherein the cooling channel cover is disposed integrally on the piston head.

15. The cooling channel cover as claimed in claim 1, wherein at least one of the two spring tabs and the two latching elements bias the body against the other of the at least one of the two spring tabs and the two latching elements.

16. The cooling channel cover as claimed in claim 1, wherein the two latching elements protrude radially outwardly from the outlet region of the at least one supply element and extend in a direction towards the inlet region where a respective free end of the two latching elements define an axial spacing from the two spring tabs.

17. The cooling channel cover as claimed in claim 1, wherein the two spring tabs are structured axially elastic and define a respective radially extending longitudinal axis oriented in the circumferential direction of the body.

18. A cooling channel cover for a piston of an internal combustion engine, comprising:

a body having mutually opposite end faces and an opening;

at least one supply element for cooling oil having an inlet region and an outlet region, the at least one supply element received in the opening and held on the body via a clipped-in latching connection;

the at least one supply element including at least one spring tab disposed at the inlet region extending radially outward in a circumferential direction of the body, and at least one latching element disposed at the outlet region that is radially elastic in the circumferential direction of the body;

wherein the at least one spring tab bears against one end face of the mutually opposite end faces and the at least one latching element bears against the other end face of the mutually opposite end faces; and wherein the at least one supply element has a passage opening defining a cross section having a radius that is larger in the circumferential direction of the body than in a radial direction of the body.

19. The cooling channel cover as claimed in claim 18, wherein the at least one spring tab bears against the one end face via a bearing surface and the at least one latching element bears against the other end face via a bearing surface, wherein the bearing surface of the at least one spring tab and the bearing surface of the at least one latching element are structured and arranged radially offset from one another such that the bearing surface of the at least one spring tab lies against the one end face in radial spaced apart relation to the bearing surface of the at least one latching element that lies against the other end face.

* * * * *